US008225874B2

(12) United States Patent
Messick et al.

(10) Patent No.: US 8,225,874 B2
(45) Date of Patent: Jul. 24, 2012

(54) GAS LIFT VALVE ASSEMBLY AND METHOD OF USING

(75) Inventors: Tyson R. Messick, Bartlesville, OK (US); Thomas M. White, Spring, TX (US); Kenneth C. Burnett, III, Bartlesville, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/683,729

(22) Filed: Jan. 7, 2010

(65) Prior Publication Data

US 2010/0108326 A1 May 6, 2010

Related U.S. Application Data

(62) Division of application No. 11/308,346, filed on Mar. 17, 2006, now Pat. No. 7,647,975.

(51) Int. Cl.
*E21B 34/06* (2006.01)

(52) U.S. Cl. ..... 166/373; 166/325

(58) Field of Classification Search ..... 166/325, 166/373, 321; 137/514.5
See application file for complete search history.

(56) References Cited

U.S. PATENT DOCUMENTS

| | | | | | |
|---|---|---|---|---|---|
| 154,177 | A | * | 8/1874 | Flanders | 137/514.5 |
| 2,059,629 | A | | 11/1936 | Erwin et al. | |
| 2,385,316 | A | | 9/1945 | Walton | |
| 2,797,700 | A | | 7/1957 | McGowen, Jr. | |
| 3,027,913 | A | | 4/1962 | Chatham et al. | |
| 3,124,151 | A | | 3/1964 | Lilly | |
| 3,845,784 | A | | 11/1974 | Sullivan | |
| 3,967,679 | A | | 7/1976 | Liljestrand | |
| 3,993,129 | A | | 11/1976 | Watkins | |
| 4,039,031 | A | * | 8/1977 | Crowe | 166/317 |
| 4,110,057 | A | | 8/1978 | McMurry et al. | |
| 4,151,857 | A | | 5/1979 | DeMoss et al. | |
| 4,239,082 | A | | 12/1980 | Terral | |
| 4,244,395 | A | | 1/1981 | Griswold et al. | |
| 4,360,064 | A | | 11/1982 | O'Connor, III et al. | |
| 4,470,464 | A | | 9/1984 | Baldenko et al. | |
| 4,592,380 | A | | 6/1986 | Hamm | |
| 4,603,735 | A | | 8/1986 | Black | |
| 5,056,790 | A | * | 10/1991 | Russell | 473/143 |
| 5,065,790 | A | * | 11/1991 | Kornas | 137/514.5 |
| 5,469,878 | A | * | 11/1995 | Pringle | 137/155 |
| 5,707,214 | A | | 1/1998 | Schmidt | |
| 5,743,717 | A | | 4/1998 | Schmidt | |
| 5,782,261 | A | | 7/1998 | Becker et al. | |
| 5,806,598 | A | | 9/1998 | Amani | |
| 5,896,924 | A | | 4/1999 | Carmody et al. | |

(Continued)

FOREIGN PATENT DOCUMENTS

GB 1492345 11/1977

(Continued)

*Primary Examiner* — Cathleen Hutchins
(74) *Attorney, Agent, or Firm* — Jim Patterson

(57) ABSTRACT

An apparatus that is usable with a well includes a gas lift valve and an isolation member. The gas lift valve includes a valve element that is located between an annulus and a passageway of a tubing. The valve element is adapted to selectively open and close to control fluid communication through the valve element. The isolation member is adapted to in a first state, isolate the valve element from at least one of the annulus and the passageway and in a second state, permit fluid communication between the valve element and the annulus or passageway.

18 Claims, 11 Drawing Sheets

U.S. PATENT DOCUMENTS

| | | | | |
|---|---|---|---|---|
| 5,937,945 | A | 8/1999 | Bussear et al. | |
| 5,971,004 | A | 10/1999 | Pringle | |
| RE36,566 | E | 2/2000 | Pringle | |
| 6,070,608 | A | 6/2000 | Pringle | |
| 6,132,191 | A * | 10/2000 | Hugenroth et al. | 418/55.1 |
| 6,148,920 | A | 11/2000 | McCalvin | |
| 7,063,152 | B2 | 6/2006 | Yeo | |
| 7,086,473 | B1 | 8/2006 | Bangash | |
| 2001/0022225 | A1 | 9/2001 | Burris et al. | |
| 2002/0029883 | A1 | 3/2002 | Vinegar et al. | |
| 2004/0182437 | A1 | 9/2004 | Messick | |
| 2005/0189107 | A1 | 9/2005 | McVay et al. | |
| 2006/0076145 | A1 | 4/2006 | Lembcke et al. | |
| 2007/0181312 | A1 | 8/2007 | Kritzler et al. | |
| 2007/0193733 | A1 | 8/2007 | Basmajian et al. | |

FOREIGN PATENT DOCUMENTS

| | | |
|---|---|---|
| GB | 2111562 | 7/1983 |
| GB | 2448018 | 10/2008 |
| SU | 617576 | 7/1978 |
| SU | 1214912 | 2/1986 |
| WO | 2007/089933 | 8/2007 |

* cited by examiner

GAS LIFT VALVE ASSEMBLY AND METHOD OF USING

CROSS REFERENCE TO RELATED APPLICATION

This application is a Divisional of U.S. application Ser. No. 11/308346 filed Mar. 17, 2006 which is still pending.

BACKGROUND

The invention generally relates to a gas lift valve assembly.

For purposes of communicating well fluid to a surface of a well, the well may include a production tubing. More specifically, the production tubing typically extends downhole into a wellbore of the well for purposes of communicating well fluid from one or more subterranean formations through a central passageway of the production tubing to the well's surface. Due to its weight, the column of well fluid that is present in the production tubing may suppress the rate at which the well fluid is produced from the formation. More specifically, the column of well fluid inside the production tubing exerts a hydrostatic pressure that increases with well depth. Thus, near a particular producing formation, the hydrostatic pressure may be significant enough to substantially slow down the rate at which the well fluid is produced from the formation.

For purposes of reducing the hydrostatic pressure and thus, enhancing the rate at which fluid is produced, an artificial-lift technique may be employed. One such technique involves injecting gas into the production tubing to displace some of the well fluid in the tubing with lighter gas. The displacement of the well fluid with the lighter gas reduces the hydrostatic pressure inside the production tubing and allows reservoir fluids to enter the wellbore at a higher flow rate. The gas to be injected into the production tubing typically is conveyed downhole via the annulus (the annular space surrounding the production tubing) and enters the production tubing through one or more gas lift valves.

As an example, FIG. 1 depicts a gas lift system 10 that includes a production tubing 14 that extends into a wellbore. For purposes of gas injection, the system 10 includes a gas compressor 12 that is located at the surface of the well to pressurize gas that is communicated to an annulus 15 of the well. To control the communication of gas between the annulus 15 and a central passageway 17 of the production tubing 14, the system 10 may include several side pocket gas lift mandrels 16 (gas lift mandrels 16*a*, 16*b* and 16*c*, depicted as examples). Each of the gas lift mandrels 16 includes an associated gas lift valve 18 (gas lift valves 18*a*, 18*b* and 18*c*, depicted as examples) for purposes of establishing one way fluid communication from the annulus 15 to the central passageway 17. Near the surface of the well, one or more of the gas lift valves 18 may be unloading valves. An unloading gas lift valve opens when the annulus pressure exceeds the production tubing pressure by a certain threshold, a feature that aids in pressurizing the annulus below the valve before the valve opens. Other gas lift valves 18, typically located farther below the surface of the well, may not having an opening pressure threshold.

The gas lift valve 18 typically contains a check valve element that opens to allow fluid flow from the annulus into the production tubing and closes when the fluid would otherwise flow in the opposite direction. For example, the production tubing 14 may be pressurized for purposes of setting a packer, actuating a tool, performing a pressure test, etc. Thus, when the pressure in the production tubing 14 exceeds the annulus pressure, the valve element is closed to ideally form a seal to prevent any flow from the tubing 14 to the annulus 15. However, it is possible that this seal may leak, and if leakage does occur, well operations that rely on production tubing pressure may not be able to be completed or performed. Thus, an intervention may be needed, which may be costly, especially for a subsea well.

Thus, there exists a continuing need for better ways to prevent a gas lift valve from leaking.

SUMMARY

In an embodiment of the invention, an apparatus that is usable with a well includes a gas lift valve and an isolation member. The gas lift valve includes a valve element that is located between an annulus and a passageway of a tubing. The valve element is adapted to selectively open and close to control fluid communication through the valve element. The isolation member is adapted to in a first state, isolate the valve element from at least one of the annulus and the passageway and in a second state, permit fluid communication between the valve element and the annulus or passageway.

In another embodiment of the invention, a system includes a production tubing, a mandrel, a gas lift valve and an isolation member. The production tubing includes a passageway to communicate well fluid and the mandrel includes a first passageway to form part of the passageway of the production tubing and a second passageway that is eccentric to the first passageway. The gas lift valve is disposed in the second passageway of the mandrel. The isolation member is adapted to in a first state, isolate the gas lift valve from at least one of the annulus and the first passageway and in a second state, permit fluid communication between the gas lift valve and the annulus or passageway.

In another embodiment of the invention, a technique that is usable with a well includes providing a gas lift valve that includes a valve element to control communication between an annulus of the well and a tubular passageway of the well in response to a pressure. The technique includes preventing leakage through the gas lift valve before the gas lift valve is to be operated. The prevention includes isolating the valve element from at least one of the annulus and the tubular passageway.

In another embodiment of the invention, an apparatus that is usable with a well includes a valve seat, a check valve element, a flow path and a suction passageway. The check valve element is adapted to engage the valve seat to block fluid communication through the valve seat in a first flow direction and retract from the seat to allow fluid communication through the valve seat in a second direction. The flow path communicates fluid flowing in the second direction in response to the retraction of the check valve element. The suction passageway is in communication with the flow path to exert a retraction force on the check valve element in response to the fluid being communicated through the flow path.

In yet another embodiment of the invention, a technique that is usable with a well includes establishing a suction flow path to exert a retraction force on a valve element of a valve to aid in opening the valve element in response to a flow through the valve.

Advantages and other features of the invention will become apparent from the following drawing, description and claims.

DETAILED DESCRIPTION

Figure 1:
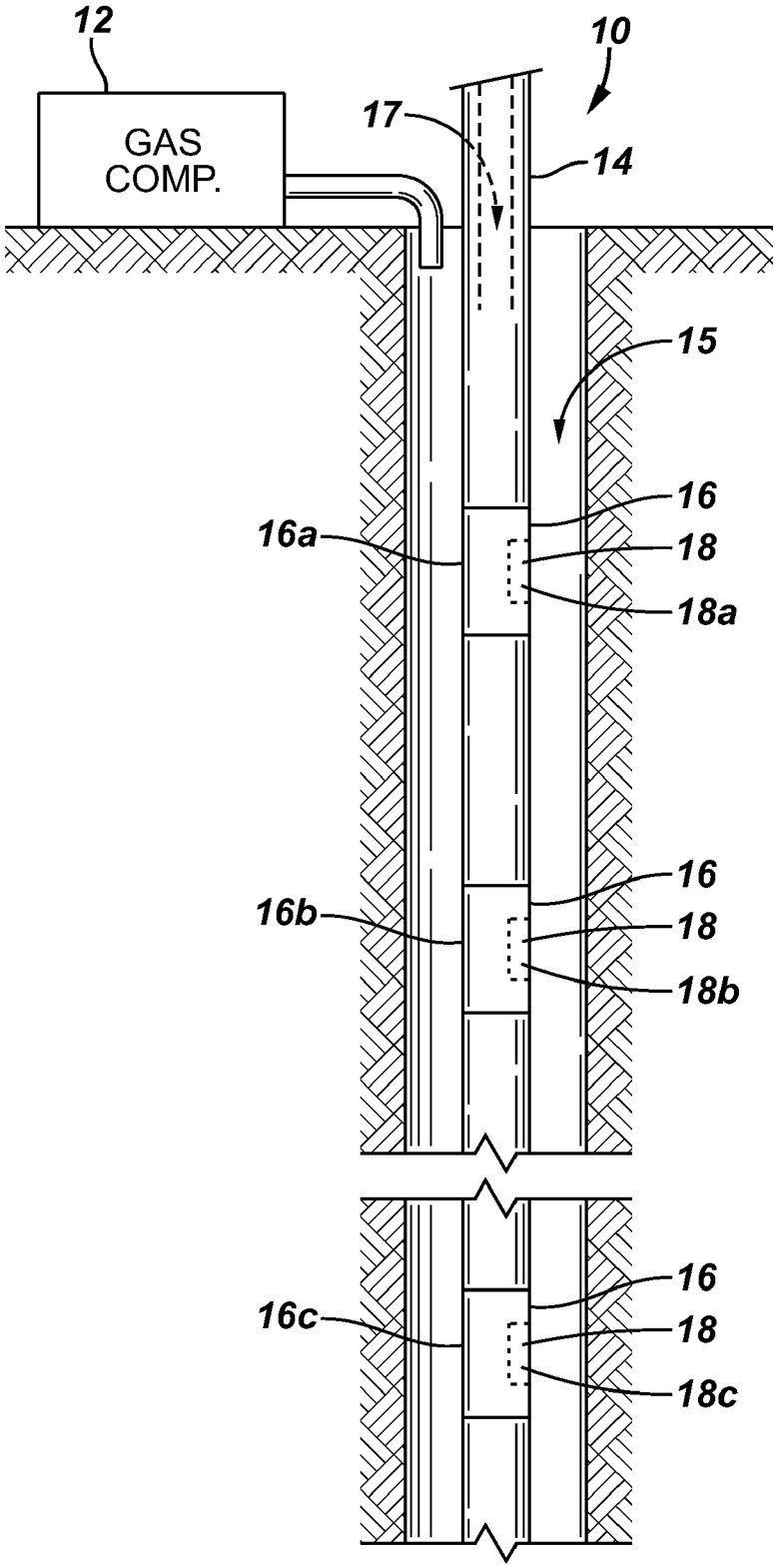
FIG. 1 (Prior Art)
FIG. 1 is a schematic diagram of a gas lift system of the prior art.
Figure 2:
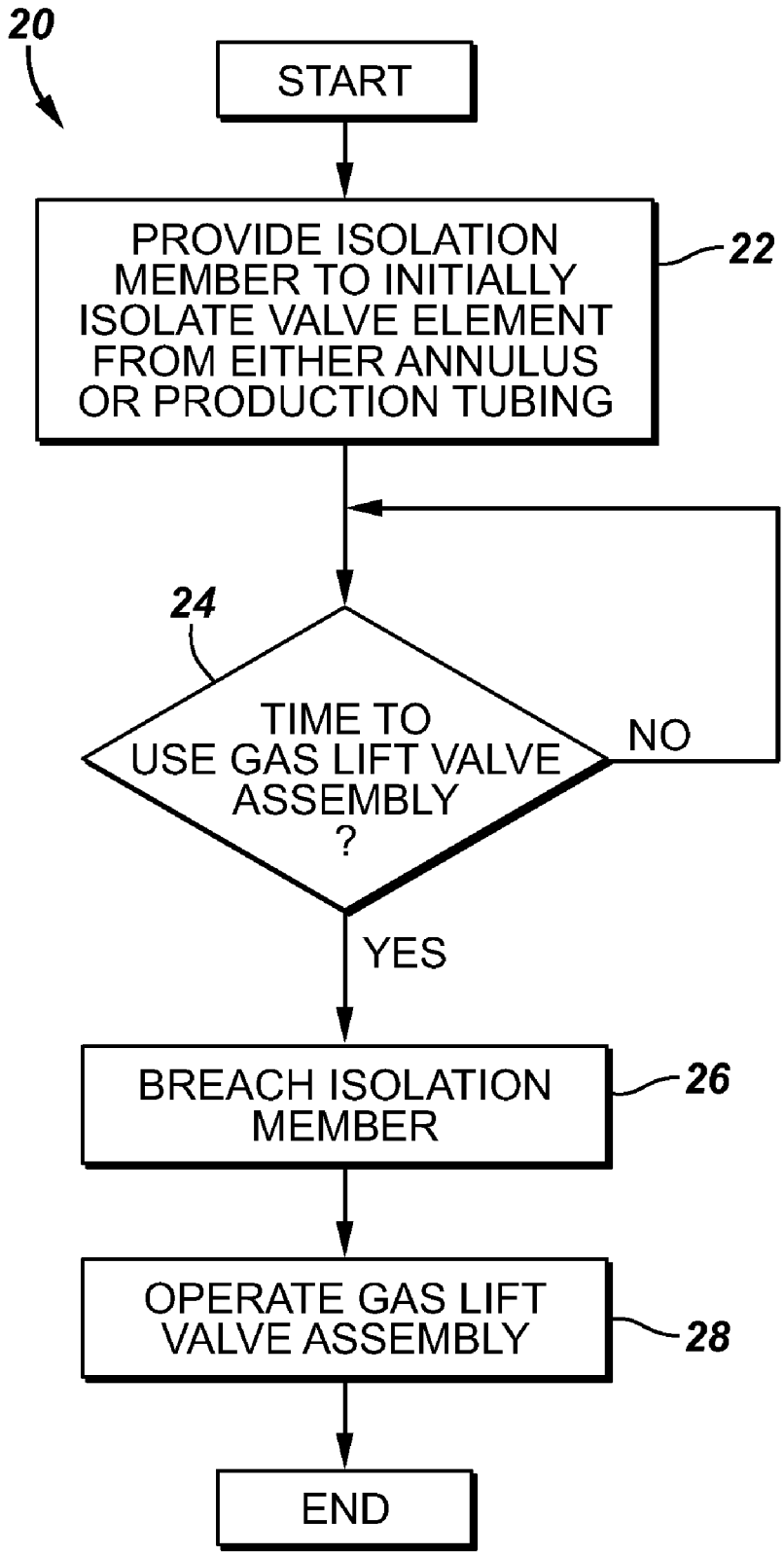
FIG. 2 is a flow diagram of a technique to prevent leakage in a gas lift valve according to an embodiment of the invention.

Referring to FIG. 2, in accordance with embodiments of the invention described herein, a technique 20 may be used to prevent leakage through a gas lift valve assembly prior to the use of the valve assembly to inject gas into the well. The technique 20 includes providing (block 22) an isolation member in the gas lift valve assembly to seal off a valve element of the assembly from either the production tubing or the annulus. Due to the seal that is achieved via the isolation member, the valve element is not relied on to block flow from the production tubing to the annulus. Therefore, production tubing pressurization operations (pressure tests, packer setting operations, tool actuation operation, etc.) may be performed without risking leakage through the valve element. As described below, when it is time to operate the gas lift valve assembly (diamond 24), the isolation member is breached (block 26), and thereafter, the valve element functions to control flow between the annulus and production tubing in the same manner as if the isolation member were never present, pursuant to block 28.

Figure 3:
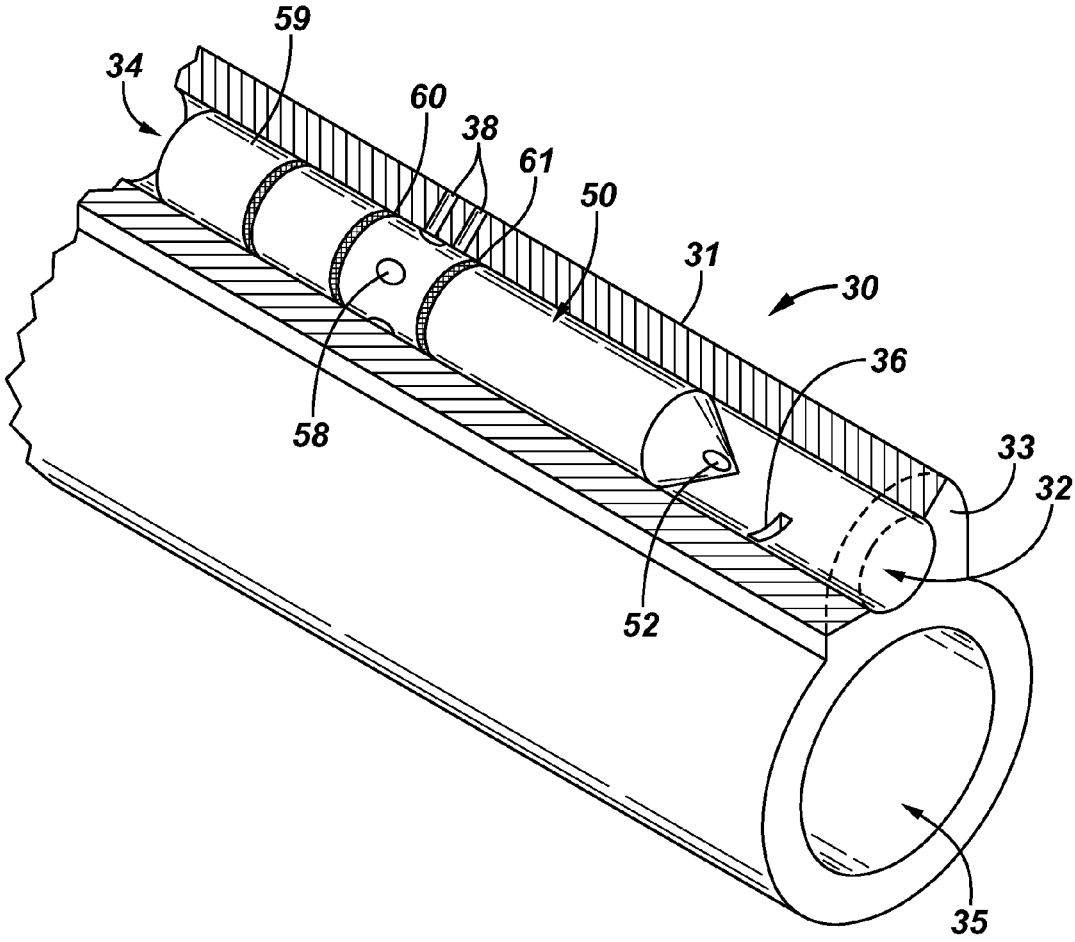
FIG. 3 is a schematic diagram of a gas lift valve assembly according to an embodiment of the invention.

As a more specific example, FIG. 3 depicts a gas lift valve assembly 30 in accordance with some embodiments of the invention. In general, the gas lift valve assembly 30 includes a gas lift valve 50 that includes a valve element (described further below), which controls communication between an annulus of the well and a central passageway of a production tubing. More specifically, the gas lift valve 50 resides inside a longitudinal passageway 32 of a mandrel 31. In addition to the longitudinal passageway 32, the mandrel 31 includes a longitudinal passageway 35 that has a larger cross-section than the passageway 32, is eccentric to the longitudinal passageway 32 and forms part of the production tubing string. As depicted in FIG. 3, the longitudinal passageways 32 and 35 are generally parallel to each other. The mandrel 31 includes at least one radial port 36 to establish communication between the longitudinal passageways 32 and 35 and also includes at least one radial port 38 to establish communication between the longitudinal passageway 32 and the annulus of the well that surrounds the mandrel 31.

In general, the gas lift valve 50 is configured to control communication between the longitudinal passageway 35 and the annulus of the well. In this regard, the gas lift valve 50 includes upper 60 and lower 61 seals (o-ring seals, v-ring seals or a combination of the above, as examples) that circumscribe the outer surface housing of the gas lift valve 50 for purposes of forming a sealed region that contains the radial ports 58 of the gas lift valve 50 and the radial ports 38. One or more lower ports 52 (located near a lower end 33 of the longitudinal passageway 32) of the gas lift valve 50 are located below the lower seal 61 and are in fluid communication with the radial ports 36 near the lower end 33, the longitudinal passageway 32 is sealed off (not shown) to complete a pocket to receive the gas lift valve 50. Due to this arrangement, the gas lift valve 50 is positioned to control communication between the radial ports 36 (i.e., the central passageway of the production tubing string) and the radial ports 38 (i.e., the annulus). As discussed above, initially, operation of the gas lift valve 50 is disabled. When operation of the gas lift valve 50 is enabled by breaching the isolation member (as described further below), the gas lift valve 50 establishes a one way communication path from the annulus to the central passageway of the production tubing. Thus, when enabled, the gas lift valve 50 permits flow from the annulus to the production tubing and ideally prevents flow in the opposite direction.

Among the other features of the gas lift valve assembly 30, in accordance with some embodiments of the invention, the assembly 30 may be installed and/or removed by a wireline operation in the well. Thus, in accordance with some embodiments of the invention, the gas lift valve assembly 30 may include a latch 59 (located near an upper end 34 of the mandrel 31) that may be engaged with a wireline tool (not shown) for purposes of installing the gas lift valve 50 in the mandrel 31 or removing the valve 50 from the mandrel 31.

The gas lift valve assembly 30 may be used in a subterranean well or in a subsea well, depending on the particular embodiment of the invention.

Figure 4:
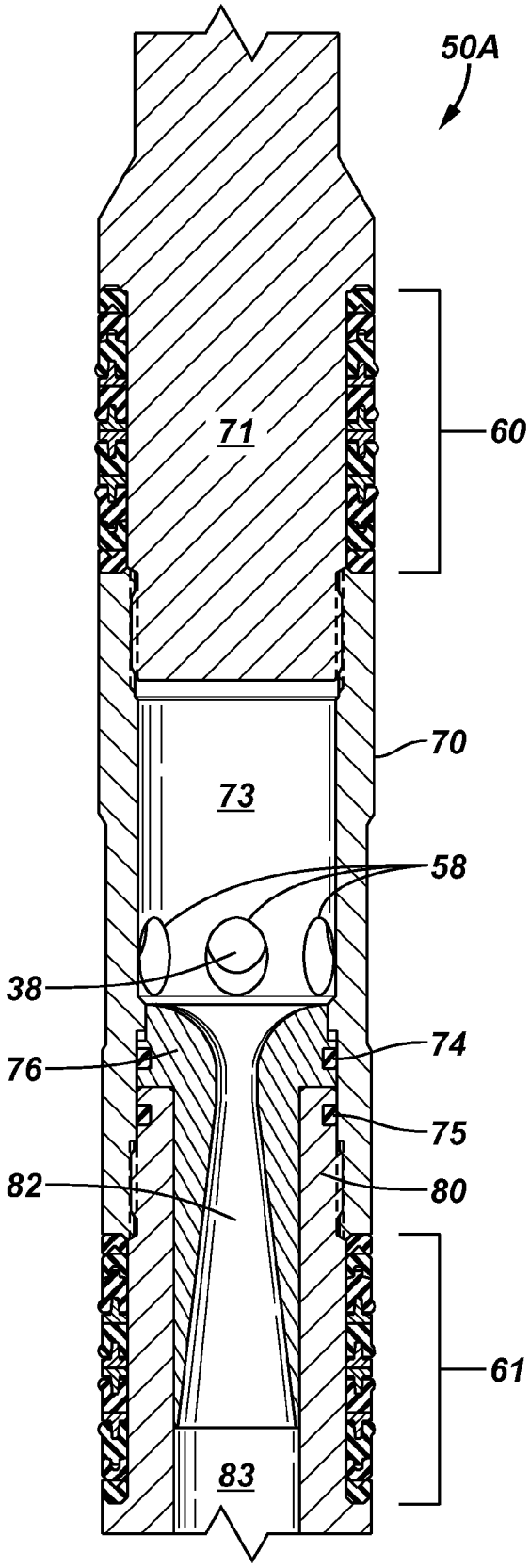
FIG. 4 is a cross-sectional view of a top portion of a gas lift valve of the gas lift valve assembly of FIG. 3 according to an embodiment of the invention.
Figure 5:
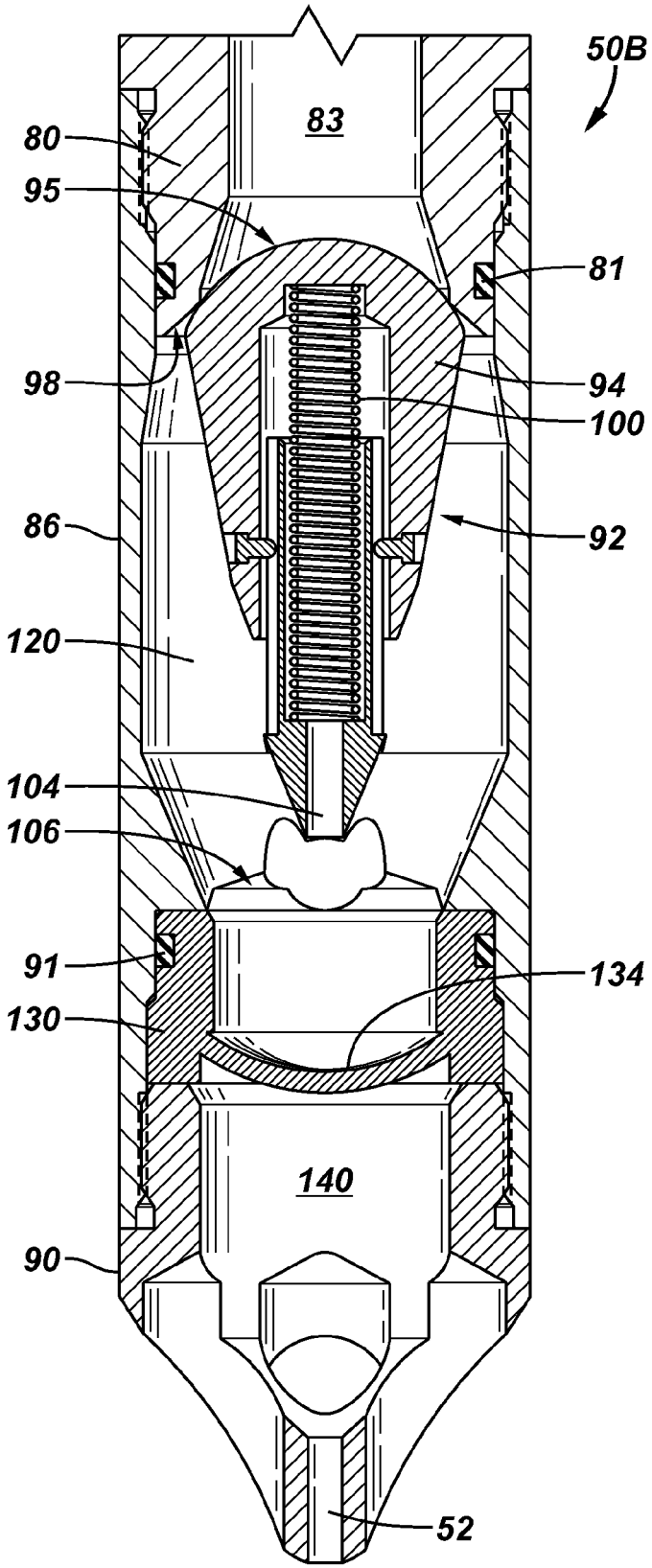
FIG. 5 is a cross-sectional view of a bottom portion of the gas lift valve of FIG. 3 according to an embodiment of the invention.

In accordance with some embodiments of the invention, the gas lift valve 50 may have a general design that is depicted in FIG. 4 (showing a top section 50A of the valve) and FIG. 5 (showing a lower section 50B of the valve). As depicted in FIG. 4, the radial ports 58 of the gas lift valve 50 may be formed in a tubular housing 70 of the valve 50. The tubular housing 70 may be connected to an upper and concentric housing section 71 (of the valve 50) that extends to the latch 59 (not depicted in FIG. 4).

The housing 70 includes an interior space 73 for purposes of receiving well fluid that flows in from the radial ports 58. Well fluid that enters the radial ports 58 flows into the interior space 73 and through a venturi orifice 82 of a venturi housing 76, which may be connected to the lower end of the housing 70, for example. The venturi housing 76 is generally concentric with respect to the housing 70, and the venturi orifice 82 minimizes turbulence in the flow of gas from the well annulus to the central passageway of the production tubing.

In other embodiments of the invention, the venturi orifice 82 may be replaced with another port, such as a square edge orifice, for example. Thus, many variations are possible and are within the scope of the appended claims.

As depicted in FIG. 4, the venturi housing 76 may be partially circumscribed by the lower end of the housing 70 and may be sealed to the housing 70 via one or more seals 74, such as o-rings, for example. Additionally, the venturi housing 76 extends inside an upper end of a lower housing 80 that is concentric with the housing 70 and extends further downhole. The housings 70 and 80 may be sealed together via one or more seals 75, such as o-rings, for example. As also depicted in FIG. 4, the lower seal 61 (formed from one or more v-type seals, o-rings, etc. for example) may generally circumscribe the outer surface of the housing 80 in accordance with some embodiments of the invention. The venturi passageway 82 is in communication with a lower passageway 83 that extends through the housing 80.

Referring to FIG. 5, in accordance with some embodiments of the invention, the lower end of the housing 80 forms a valve seat 98, a seat that is opened and closed (for purposes of controlling the one-way flow through the gas lift valve 50) via a check valve assembly 92.

In accordance with some embodiments of the invention, the check valve assembly 92 is a spring-loaded assembly (due to a spring 100), which controls when a dome-shaped portion as of a valve element 94 (of the assembly 92) allows or closes off fluid communication through the valve seat 98. More particularly, the check valve assembly 92 exerts an upward bias force on the valve element 94 for purposes of biasing the valve element 94 to close off fluid communication through the valve seat 98. The valve element 94 is generally tapered leading away from the dome-shaped portion 95 so that the portion 95 is forced into the valve seat 98 should the production tubing pressure become greater than the annulus pressure. When, however, the annulus pressure is sufficient (relative to the production tubing pressure) to exert a force on the valve element 94 to overcome the spring bias, the valve element 94 retracts to permit fluid to flow from the annulus into the production tubing.

As depicted in FIG. 5, the lower end of the housing 84 may be sealed via an o-ring 81, for example, to a lower housing 86 that extends further downwardly toward the lower port 52 of the gas lift valve 50. An interior space 120 inside the housing 86 is in communication with the production tubing side of the gas lift valve 50 and receives annulus well fluid that opens the check valve assembly 92 and flows through the valve seat 98. As also depicted in FIG. 5, a lower end 104 of the check valve assembly 92 may be secured via a socket-type connection 106 to the housing 86.

Ideally, fluid cannot flow from the production tubing side of the check valve assembly 92 to the annulus side. However, because leaks may occur, the gas lift valve 50, in accordance with some embodiments of the invention, includes a rupture disk assembly 130. As depicted in FIG. 5, the rupture disk assembly 130 may be sealed to the housing 86 via one or more o-rings 91. The rupture disk assembly 130 includes a rupture disk 134 that, when the gas lift valve 50 is initially installed in the well, forms a barrier to isolate the production tubing passageway from the check valve assembly 92. Therefore, initially, the check valve assembly 92 is isolated from the production tubing to allow pressurizations of the production tubing bore without the possibilities of leakage into the well annulus.

When it is time to use the gas lift valve 50, pressure in the production tubing passageway is increased to a pressure threshold that exceeds the rating of the rupture disk 134 and is significantly above any pressure differential that may develop across the disk 134 during other prior production tubing pressurization operations. In other words, when the pressure in the central passageway of the production tubing overcomes the rating of the rupture disk 134, the disk 134 ruptures, or is breached, to open communication between the central passageway of the production tubing and the check valve assembly 92. Once this occurs, the check valve assembly 92 is enabled to control flow through the gas lift valve 50 so that from this point on the valve 50 is operated as if the rupture disk assembly 130 were never present in the valve 50.

Among the other features depicted in FIG. 5, in accordance with some embodiments of the invention, the gas lift valve 50 may include a lower nose housing 90 that is concentric with the housing 86 and is connected to the lower end of the housing 86. The nose 90 includes an interior space 140 that is in fluid communication with the central passageway of the production tubing via the port 52.

Figure 6:
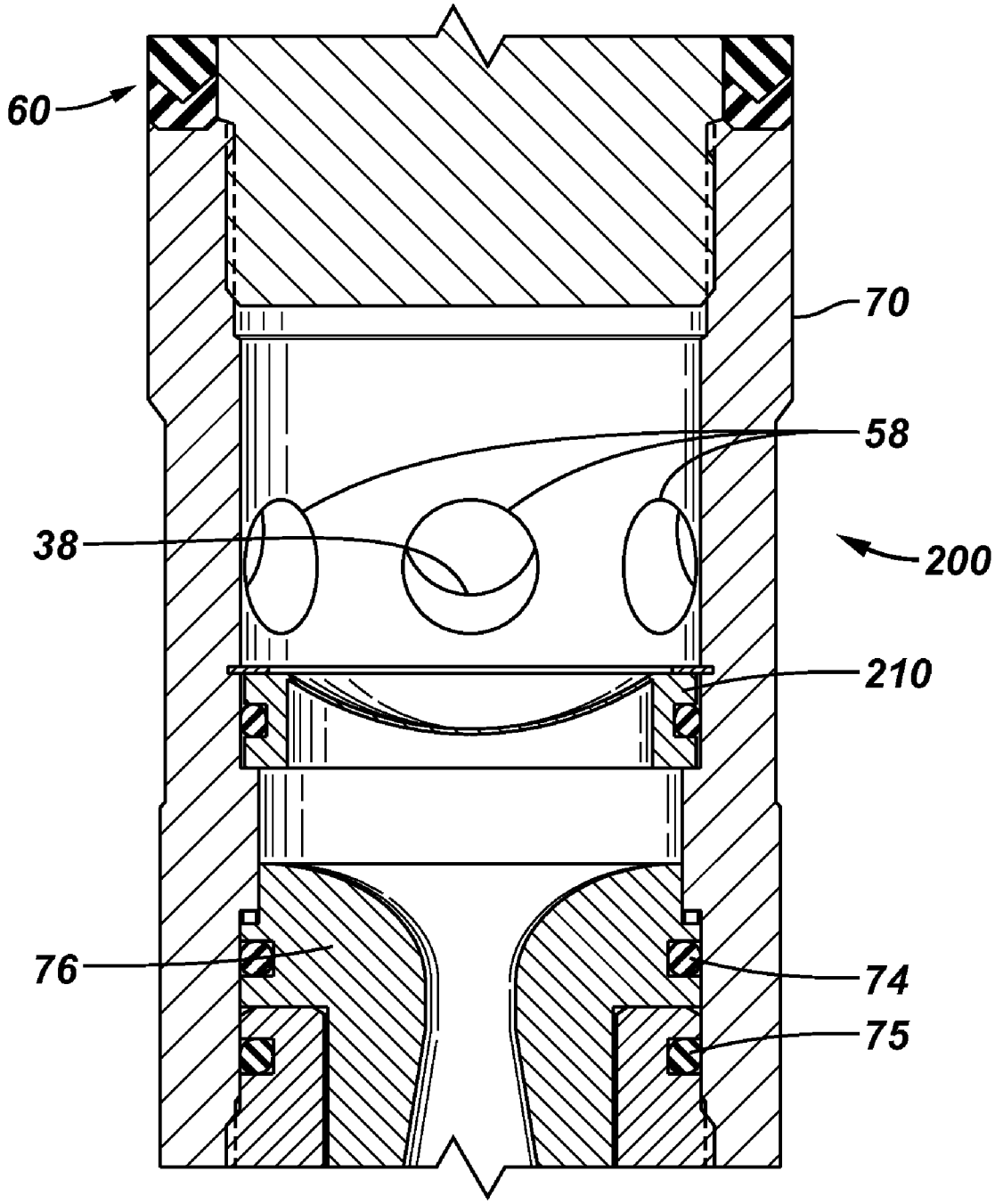
FIGS. 6, 7 and 8 illustrate different locations for a rupture disk of the gas lift valve assembly according to other embodiments of the invention.

It is noted that the rupture disk assembly 130 may be located in other places in the gas lift valve 50 and more generally, in other places inside the gas lift valve assembly 30, in accordance with other embodiments of the invention. For example, referring to FIG. 6, in accordance with some embodiments of the invention, a gas lift valve 200 has the same general design as the gas lift valve 50 with similar reference numerals being used to depict similar components. However, unlike the gas lift valve 50, the gas lift valve 200 has a rupture valve assembly 200 that is positioned downstream of the radial ports 58 between the ports 58 and the venturi housing 76. Thus, the rupture disk assembly 210 is located upstream of the check valve assembly 92 inside the valve 200 so that pressure in the well annulus (instead of in the passageway of the production tubing) may be increased until the pressure exceeds the threshold of which the rupture disk assembly 210 ruptures. At this point, communication is established between the check valve assembly 92 and the well annulus.

Figure 7:
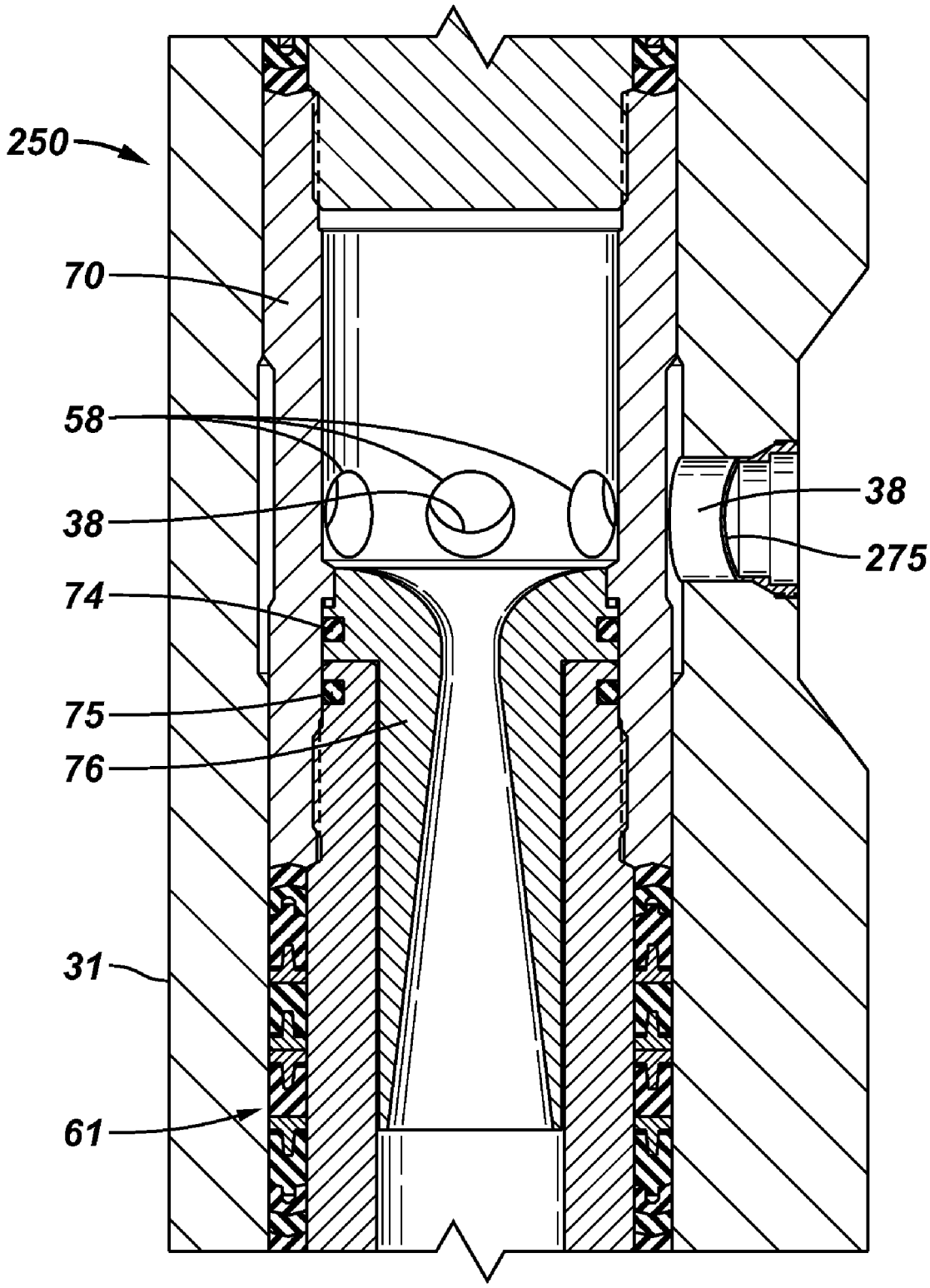

As another example, in accordance with other embodiments of the invention, a gas lift valve assembly 250, depicted in FIG. 7, may have the same general design as the gas lift valve assembly 30 (with like reference numerals being used), except that the gas lift valve assembly 250 includes a rupture valve assembly in the radial port 38 of the mandrel 31. Thus, each radial port 38 may include an associated rupture disk assembly 275 so that when the pressure inside the well annulus exceeds a predefined threshold, one or more rupture disk assemblies 275 rupture to establish communication between the well annulus and the check valve assembly 92.

Figure 8:
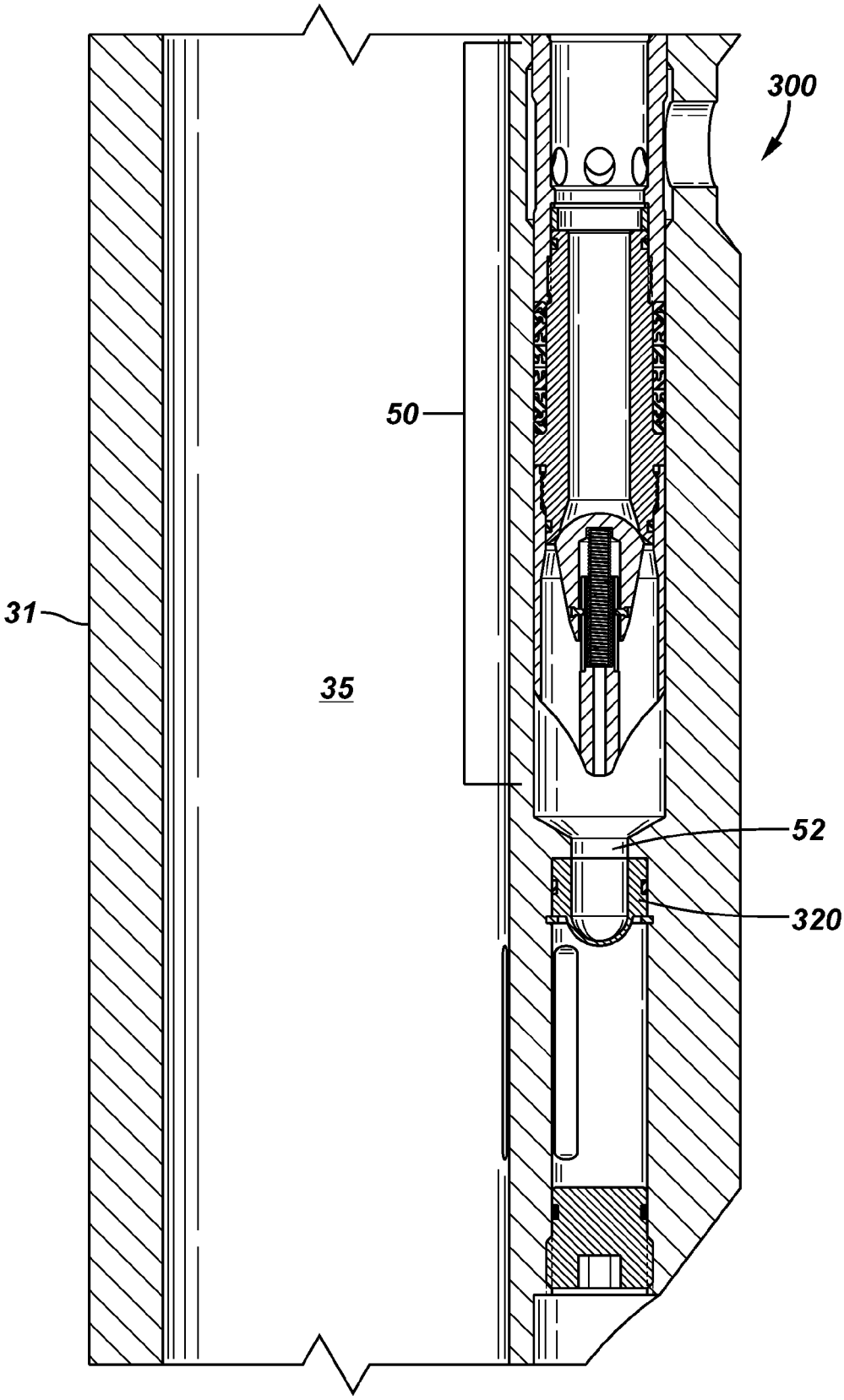

As yet another example of a potential placement option for a rupture disk assembly, FIG. 8 depicts a gas lift valve assembly 300 in accordance with some embodiments of the invention. The gas lift valve assembly 300 has the same general design as the gas lift valve assembly 30 (with like reference numerals being used), with the following differences. In particular, unlike the gas lift valve assembly 50, the gas lift valve assembly 300 includes a rupture disk assembly 320 (replacing the rupture disk assembly 130 (see FIG. 5)) that is located downstream of the port 52 inside the mandrel passageway 32 (see FIG. 3, for example). Thus, FIG. 8 illustrates an arrangement in which a rupture disk assembly may be located inside the mandrel 31 to initially isolate the check valve assembly 92 from pressure in the central passageway of the production tubing.

Other variations are possible and are with the scope of the appended claims. For example, in accordance with other embodiments of the invention, an isolation member other than a rupture disk, may be used to initially isolate the valve element of the gas lift valve. More specifically, in accordance with other embodiments of the invention, a sleeve valve may be used to initially isolate the valve element of a gas lift valve. In this regard, the sleeve valve may include a sleeve that is, for example, mounted on the exterior of the mandrel 31 to initially cover and close off communication through the radial ports 38. Upon application of sufficient well annulus or production tubing bore pressure, this sleeve is permanently displaced to expose the radial ports 38 and thus, open communication between the well annulus and the valve element of the gas lift valve. Similarly, a valve, such as a sleeve valve, may be used to initially isolate the port(s) 52, the port(s) 36, etc. Thus, many variations are possible and are within the scope of the appended claims.

Figure 9:
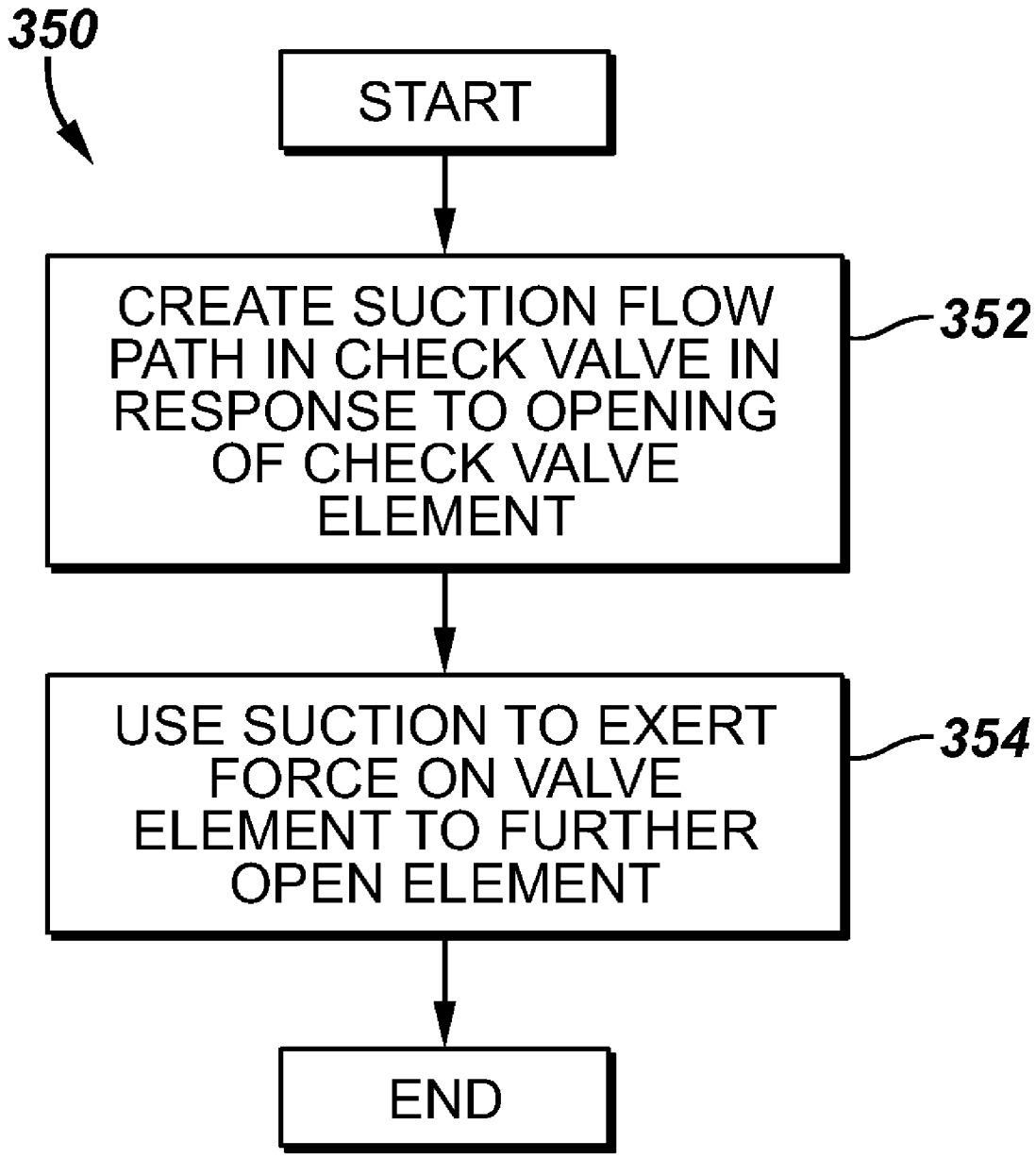
FIG. 9 is a flow diagram depicting a technique to use a suction force to aid in opening a check valve element according to an embodiment of the invention.

In accordance with some embodiments of the invention, a suction force is used for purposes of aiding operation of a valve element, such as the check valve element of a gas lift valve, for example. More specifically, referring to FIG. 9, in accordance with some embodiments of the invention, a technique 350 to operate a check valve assembly in accordance with some embodiments of the invention, includes creating (block 352) a suction flow path in a check valve in response to the opening of the check valve element. The suction is used (block 354) to exert a force on the valve element to aid in opening the element.

Figure 10:
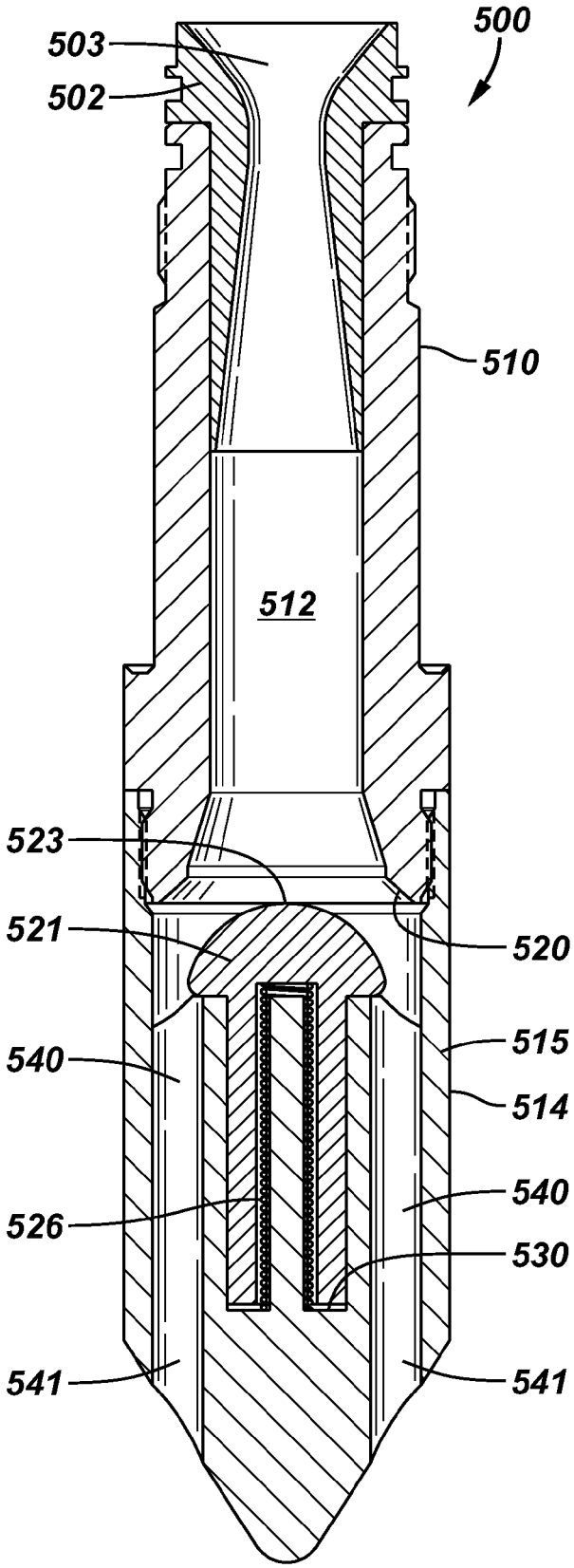
FIG. 10 is a cross-sectional view of a check valve assembly according to an embodiment of the invention.

To further illustrate the technique 350, FIG. 10 generally depicts a valve 500 in accordance with some embodiments of the invention. The valve 500 includes a tubular housing 510, the lower end of which forms a seat 520 for the valve 500. As shown in FIG. 10, a venturi housing 502 that includes an upper opening 503 (in communication with a well annulus, for example) may be attached to the upper end of the housing 510 in accordance with some embodiments of the invention. Fluid communication through the valve seat 520 is controlled by a check valve assembly 514 that is attached to the lower end of the housing 510.

As depicted in FIG. 10, the check valve assembly 514 includes a dart-shaped body 515 that is attached to the lower end of the housing 510. The body 515 includes a cylindrical recessed portion 530 that is generally concentric with the body 515 and receives a valve element 521. A top portion 523 of the valve element 521 is dome-shaped so that when the valve element 521 extends upwardly, the dome-shaped portion 523 enters the valve seat 520 to form a fluid-tight seal to block off fluid flow through the valve 500. A coil spring 526 is disposed inside the recessed portion 530 for purposes of exerting an upward force on the valve element 521 to bias the valve 500 closed.

When a sufficient pressure is exerted by the fluid that enters the opening 503, the pressure forces the valve element 521 downwardly to cause the valve element 521 to retract from the valve seat 520 to open the valve 500. Thus, FIG. 10 depicts the valve 500 in its open state.

The body 515 includes longitudinal passageways 540 that are generally parallel to the longitudinal axis of the valve 500 and may be regularly spaced about the longitudinal axis of the body 515. Each longitudinal passageway 540 extends from a region of the body 515 near the valve seat 520 to a lower outlet 541 where the well fluid exits the valve 500.

In accordance with some embodiments of the invention, the body 515 also includes suction flow paths for purposes of exerting a force on the dome-shaped portion 521 to aid in opening in the valve element 521.

Figure 11:
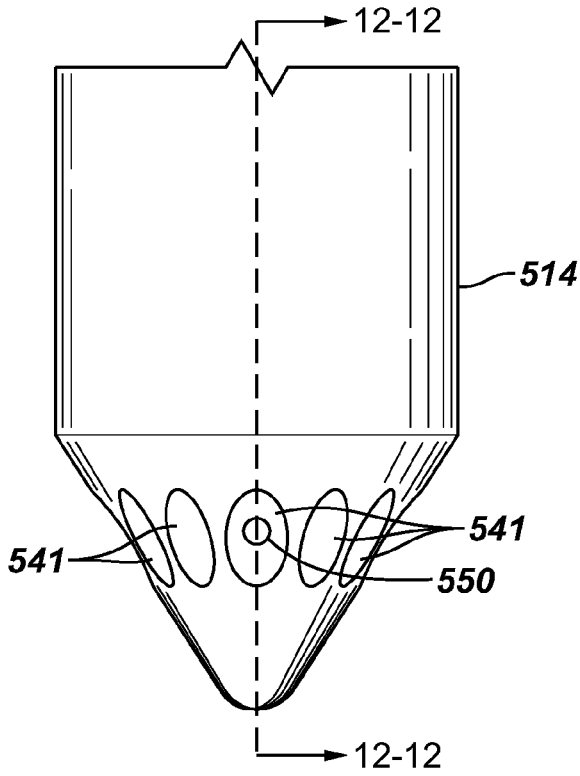
FIG. 11 is a perspective view of a nose of a dart of the check valve assembly of FIG. 10 according to an embodiment of the invention.
Figure 12:
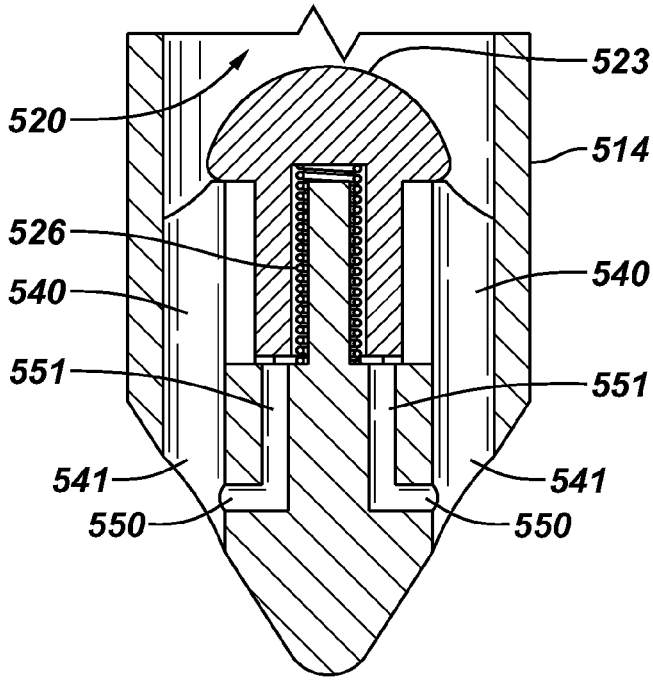
FIG. 12 is a cross-sectional view taken along line 12-12 of FIG. 11 according to an embodiment of the invention.

More specifically, referring also to FIGS. 11 and 12, in accordance with some embodiments of the invention, the body 515 includes one or more suction flow paths, each of which is exposed at its lower opening 550 to one of the longitudinal passageways 541. Referring also to FIG. 12, near each opening 550, the suction flow path is orthogonal to the longitudinal flow path 540. As can also be seen from FIG. 12, each suction flow path turns at a right angle toward the recessed portion 530 that receives the valve element 521. Thus, each suction flow path also includes a longitudinal portion 551 that is generally parallel to the longitudinal passageways 540.

Due to this arrangement, when the valve element 521 begins to retract and move out of the valve seat 520, a flow is established through the longitudinal passageways 540. This flow, in turn, creates suction in each of the suction flow paths. Thus, the suction is communicated beneath the dome-shaped portion 523 of the valve element 521 to exert a force on the valve element 521 to further retract the element 521. Therefore, the suction flow paths produce an opening force for the check valve assembly 514.

In the preceding description, directional terms, such as "upper," "lower," "vertical," "horizontal," etc. may have been used for reasons of convenience to describe the gas lift valve and its associated components. However, such orientations are not needed to practice the invention, and thus, other orientations are possible in other embodiments of the invention. For example, the gas lift valve and its associated components, in some embodiments in some embodiments of the invention, may be tilted by approximately 90° in some embodiments or by 180° in other embodiments to the orientations that are depicted in the figures.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A gas lift valve usable with a well, comprising:

a valve seat;

a check valve element adapted to engage the valve seat to block fluid communication through the valve seat in a first flow direction and retract from the seat to allow fluid communication through the valve seat in a second direction; and a body to guide movement of the check valve element along a longitudinal axis wherein the body comprises a conical portion;

a longitudinal passageway to communicate fluid flowing in the second direction in response to the retraction of the check valve element wherein the longitudinal passageway comprises an opening disposed along the conical portion of the body; and a suction passageway in communication with the longitudinal passageway to exert a retraction force on the check valve element in response to the fluid being communicated through the longitudinal passageway wherein the suction passageway comprises an opening that coincides with the opening of the longitudinal passageway disposed along the conical portion of the body; and wherein the suction passageway comprises a first path that meets the longitudinal passageway, the first path being substantially orthogonal to the longitudinal passageway wherein the first path and the longitudinal passageway meet.

2. The gas lift valve of claim 1 wherein the suction passageway further comprises a second path that extends between the first path and a check valve element portion of the body, the second path between substantially parallel to the longitudinal passageway.

3. The gas lift valve of claim 1, wherein the check valve comprises a dome-shaped element to engage the valve seat.

4. The gas lift valve of claim 1 wherein the body comprises a plurality of longitudinal passageways.

5. The gas lift valve of claim 4 wherein each of the plurality of longitudinal passageways comprises a corresponding suction passageway.

6. The gas lift valve of claim 1 wherein the body comprises a unitary body.

7. The gas lift valve of claim 1 wherein the body comprises a stem for seating a spring.

8. The gas lift valve of claim 7 wherein the valve check element comprises a surface to seat an end of the spring.

9. The gas lift valve of claim 7 wherein the suction passageway of the body comprises an opening disposed at a surface from which the stem extends.

10. The gas lift valve of claim 1 wherein a radial dimension of the opening of the suction passageway and a radial dimension of an outer, cylindrical surface of the body differ and characterize the body.

11. The gas lift valve of claim 1 wherein, upon placement of the body in a cylindrical conduit, the conical portion of the body defines an annular flow region having a varying cross-sectional area.

12. The gas lift valve of claim 11 wherein the opening of the suction passageway corresponds to a cross-sectional area greater than a minimum of the varying cross-sectional area and less than a maximum of the varying cross-sectional area.

13. The gas lift valve of claim 1 wherein the opening of the longitudinal passageway comprises an oval-shaped perimeter.

14. The gas lift valve of claim 1 wherein the opening of the longitudinal passageway provides access to the opening of the suction passageway along a line orthogonal to the longitudinal axis of the body.

15. A method usable with a well, comprising:

locating a gas lift valve in the well and integrating the gas lift valve with a side pocket mandrel that is part of production tubing; and establishing retraction force on a valve element to aid in opening a valve in response to a flow through the valve wherein the establishing comprises flowing fluid through a longitudinal passageway of a body that guides the valve element flowing the fluid through an opening of the longitudinal passageway, the opening disposed along a conical portion of the body, and responsive to the flowing fluid through the opening, creating the retraction force at an opening of a suction passageway that coincides with the opening of the longitudinal passageway disposed along the conical portion of the body; and providing the suction passageway with at least one path substantially orthogonal to the longitudinal passageway so that the flow establishes suction in said at least one path.

16. The method of claim 15, further comprising:

using the retraction force to aid in operating the gas lift valve.

17. The method of claim 15, wherein the act of establishing comprises:

providing communication between said at least one path and at least one surface of the valve element.

18. The method of claim 15 further comprising forming the opening of the suction passageway via the opening of the longitudinal passageway disposed along the conical portion.

* * * * *